US005831647A

United States Patent [19]

Kawakami et al.

[11] Patent Number: 5,831,647

[45] Date of Patent: Nov. 3, 1998

[54] CASING STRUCTURE IN AN INK JET PRINTER FOR IMPROVED USED INK HANDLING

[75] Inventors: Kazuhisa Kawakami; Masahiro Isono; Shigenori Fukasawa, all of Nagano, Japan

[73] Assignee: Seiko Epson Corporation, Tokyo, Japan

[21] Appl. No.: 653,484

[22] Filed: May 24, 1996

[30] Foreign Application Priority Data

May 25, 1995 [JP] Japan ..... 7-151009
May 25, 1995 [JP] Japan ..... 7-151012

[51] Int. Cl.[6] ..... B41J 2/165; B41J 29/13

[52] U.S. Cl. ..... 347/36; 347/108

[58] Field of Search ..... 347/36, 108, 86, 347/34, 138, 152, 170, 222, 245

[56] References Cited

U.S. PATENT DOCUMENTS

| | | | |
|---|---|---|---|
| 4,580,147 | 4/1986 | De Young et al. | 347/88 |
| 5,113,206 | 5/1992 | Fukazawa | 347/36 |
| 5,291,227 | 3/1994 | Suzuki | 347/36 |
| 5,406,316 | 4/1995 | Schwiebert et al. | 347/18 |

FOREIGN PATENT DOCUMENTS

| | | | |
|---|---|---|---|
| 0649750 | 9/1994 | European Pat. Off. . | |
| 3406865 | 8/1985 | Germany . | |
| 361012352 | 1/1986 | Japan | B41J 3/04 |
| 2241748 | 9/1990 | Japan . | |
| 3227658 | 10/1991 | Japan . | |
| 405278229 | 10/1993 | Japan | B41J 2/18 |
| 5261938 | 10/1993 | Japan . | |
| 7314729 | 12/1995 | Japan . | |
| 002242867 | 10/1991 | United Kingdom | B41J 2/185 |
| 9104156 | 4/1991 | WIPO . | |

*Primary Examiner*—Benjamin R. Fuller
*Assistant Examiner*—Thien Tran
*Attorney, Agent, or Firm*—Sughrue, Mion, Zinn, Macpeak & Seas, PLLC

[57] ABSTRACT

An ink jet printer casing which reduces the volume and thickness of a used ink tank by fully utilizing the inherent ink absorbing capability of the ink absorbing substance. A used ink containing room, defined by side walls, is formed on the bottom surface of the casing. The used ink containing room is divided into a plural number of segmental regions by partitioning plates. Individual segments of ink absorbing substance made of a porous material are placed in the segmental regions, respectively. If the casing is tilted, the water heads of the segments of ink absorbing substance are low as a whole when viewed in the vertical direction since the segments of ink absorbing substance are isolated from one another by the partitioning plates. The ink absorbing substance may also be formed as a single member, and the ink led to a central part of the used ink containing room.

16 Claims, 8 Drawing Sheets

CASING STRUCTURE IN AN INK JET PRINTER FOR IMPROVED USED INK HANDLING

BACKGROUND OF THE INVENTION

1. Field of the Invention

The present invention relates to the structure of an ink jet printer casing with a used ink tank for receiving used ink from a cap means into which the used ink is discharged from a print head.

2. Discussion of the Related Art

In an ink jet printer, through nozzle holes of extremely small diameter, ink is shot forth to a print paper, thereby forming dots on the paper. The ink has a relatively high viscosity and a tendency to be dried at a relatively high speed. Accordingly, the nozzle holes will frequently be clogged with ink.

For this reason, a so-called ink jetting-ability restoring operation is required. In the restoring operation, a cap means is applied to the print head to cover the openings of the nozzle holes thereof and, in this state, a negative pressure is applied to the nozzle holes, thereby forcibly pulling residual ink out of the nozzle holes.

When the printer is first used or when the ink is replaced with a new one, a so-called ink-charging operation is performed. In the ink-charging operation, a great amount of ink is sucked from the print head to remove maintenance liquid and bubbles.

In this case, the sucked ink is transferred to a used ink tank containing an ink absorbing substance such as, for example, felt. The used ink tank is mounted on a casing of a printer body.

In view of the ongoing demand for size reduction of the printer, a designer is confronted with the problem of how to secure a space for the used ink tank within the casing. The circumstances compel the designer to actively use empty spaces existing in the bottom portion of the casing and the like. This necessitates the spreading out of a thin ink absorbing substance.

The ink absorbing substance is made of a porous material. The ink holding capability of the ink absorbing substance is limited by the thickness of the substance when viewed in the vertical direction. When the casing is normally installed, the ink absorbing substance exhibits a normal ink holding capability. However, when the effective vertical length of the ink absorbing substance is increased, for example, when it is inclined, its water head is raised, its ink or liquid holding capability is decreased, so that the ink absorbing substance cannot hold the ink, and consequently the ink thus far held thereby flows out of the ink absorbing substance.

To avoid this, in designing the ink absorbing substance to be contained in the used ink tank, its necessary volume of absorbing ink is estimated at approximately 50% of the total volume of the ink absorbing substance. The result is an increase of the space reserved for the used ink tank and, hence, an excessive increase of the volume of the casing.

Moreover, to improve the print quality, blotting of ink on the print paper must be minimized. To this end, an ink of the quick dry type is used. In this case, as the ink absorbing substance is thinner, used ink is more easily hardened. As a result, the flow of the used ink to the ink absorbing substance is impeded. Further, an amount of the used ink absorbed by the ink absorbing substance is much smaller than that defined by the ink holding capability of the ink absorbing substance.

If the used ink is incompletely absorbed by the ink absorbing substance, the used ink is left and flows to the power unit, thereby possibly causing problems such as, for example, shortcircuiting.

The present invention has been made in view of the above circumstances and has as an object the provision of a casing structure which is well adaptable for an ink jet printer and which is capable of efficiently containing used ink by fully utilizing the inherent ink absorbing capability of the ink absorbing substance.

Another object of the present invention is to provide a casing structure which is capable of protecting a power unit from the used ink.

To solve the above problems, there is provided an ink jet printer casing for housing an ink jet printer, the ink jet printer having a print mechanism including an ink jet print head, a cap means for sealing the print head, and a pump, communicating with the cap means, for sucking ink from the print head, the ink jet printer casing comprising: a bottom surface and a plurality of side walls extending upwardly therefrom; a used ink containing room formed on the bottom surface of the casing and being defined by upstanding walls, the used ink containing room being divided into a plural number of segmental regions by partitioning plates; and segments of ink absorbing substance made of a porous material being placed in the segmental regions, respectively.

Accordingly, if the casing is tilted and the water head thereof when viewed in the vertical direction is increased, the water heads of the individual segments of ink absorbing substance are within the ink absorbing capabilities inherent to the ink absorbing substance since the segments of ink absorbing substance are isolated from one another.

There is further provided an ink jet printer casing for housing an ink jet printer, the ink jet printer having a print mechanism including an ink jet print head, a cap means for sealing the print head, and a pump, communicating with the cap means, for sucking ink from the print head, the ink jet printer casing comprising: a bottom surface and a plurality of side walls extending upwardly therefrom; a used ink containing room formed on the bottom surface of the casing and being defined by upstanding walls, said used ink containing room having an ink absorbing member disposed therein; and a power unit compartment for containing a power unit and which is defined by partitioning walls formed integral with two adjacent side walls of said plurality of side walls and the bottom surface of the casing, while facing one of the upstanding walls defining the used ink containing room.

The structure of the casing further comprises a used ink receiving port for receiving ink from the pump, and a used ink guide path, comprising narrow grooves, for connecting the used ink receiving port to the central part of the used ink containing room. The used ink receiving port is in contact with one of the upstanding walls of the used ink containing room. The ink absorbing member is placed so as to cover the used ink guide path.

With such a structure, used ink is absorbed at the central part of the ink absorbing member. Even if the used ink is hardened at a particular region, the used ink bypasses that region to flow to another region, and, hence, the ink absorbing substance satisfactorily absorbs the used ink. If the used ink leaks from the used ink containing room, the partitioning walls partially defining the power unit compartment perfectly block the flow of the used ink to the power unit compartment. Accordingly, the problems caused by the leaked ink, such as shortcircuiting, are successfully solved.

Further, the used ink is led to the central part of the ink absorbing substance, and is brought into contact with a broader area of the ink absorbing substance, thereby realizing an efficient absorption of the used ink by the substance.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

The preferred embodiments of the present invention will now be described with reference to the accompanying drawings.

Figure 1:
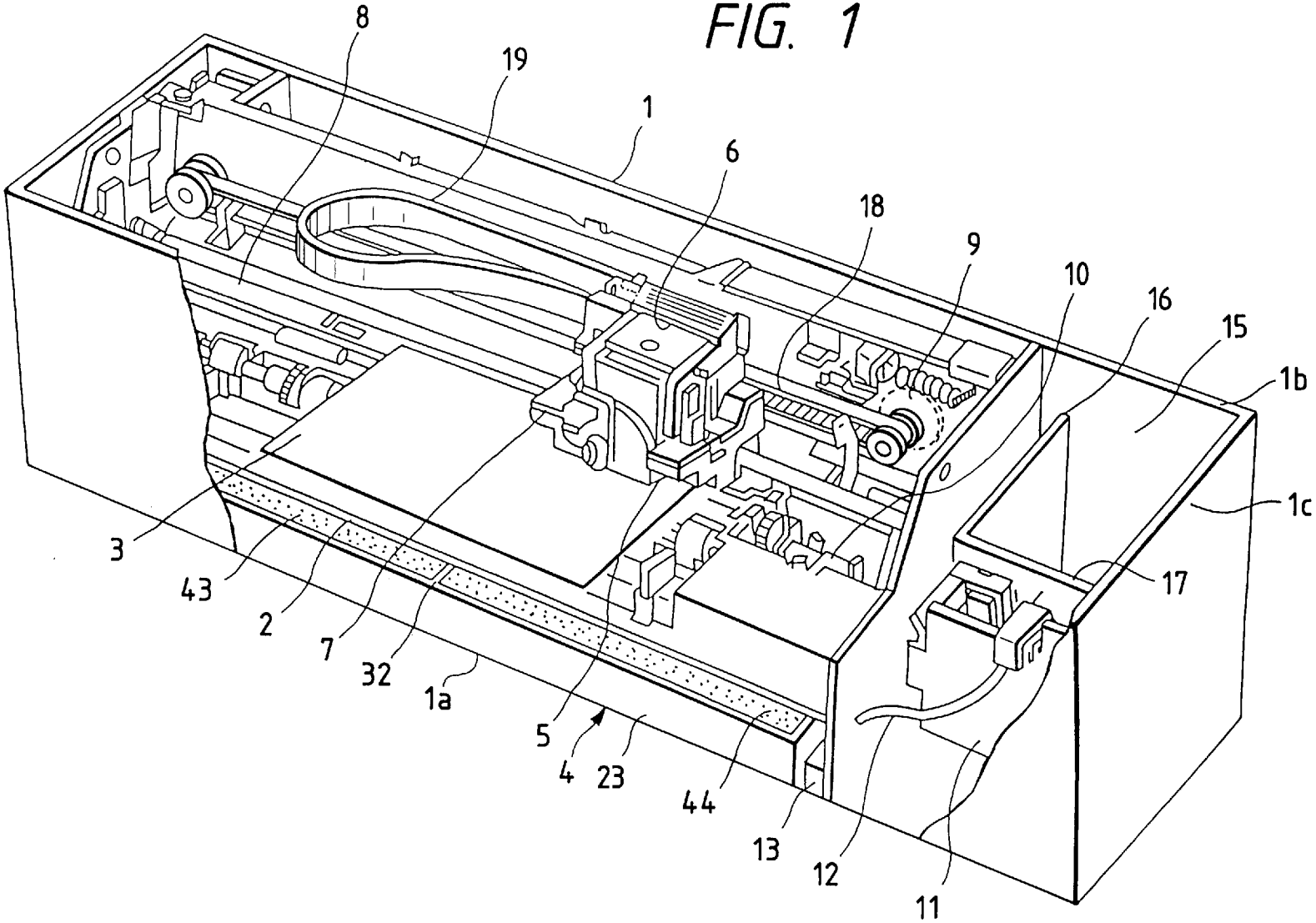
FIG. 1 is a perspective view showing an ink jet printer with a used ink tank constructed according to a first aspect of the present invention, a casing thereof being illustrated in a partial break-away fashion.

Reference is made to FIG. 1 showing an embodiment according to a first aspect of the present invention. In the figure, reference numeral 1 designates a casing. The inner space of the casing is segmented into an upper space 3 and a lower space 4 by a substrate 2. The upper space 3 contains a print mechanism and a cap means 10 for capping the openings of the nozzle holes of a print head 5 therewith when the printer is not operated. The print mechanism includes a carriage 7 which carries thereon the print head 5 and an ink cartridge 6, a motor 9 for reciprocatively moving the carriage 7 along a platen 8, and the like.

The cap means 10 is connected to a suction port of a suction pump 11 through a fluid path, not shown, and receives a negative pressure from the suction pump 11 when the ink charging operation or the ink jetting-ability restoring operation is performed. A discharging port of the suction pump 11 communicates with a used ink receiving port 13 by way of a tube 12.

A power unit compartment 15, which occupies a part of the inner space of the casing 1, is partially defined by partitioning walls 16 and 17 standing upright from the bottom surface la of the casing 1. The partitioning walls 16 and 17 are formed integral with the two side walls 1*b* and 1*c* of the casing, which abut each other. A timing belt 18 operatively connects the motor 9 to the carriage 7. A flexible cable 19 is used for transmitting signals to the print head 5.

Figure 2A:
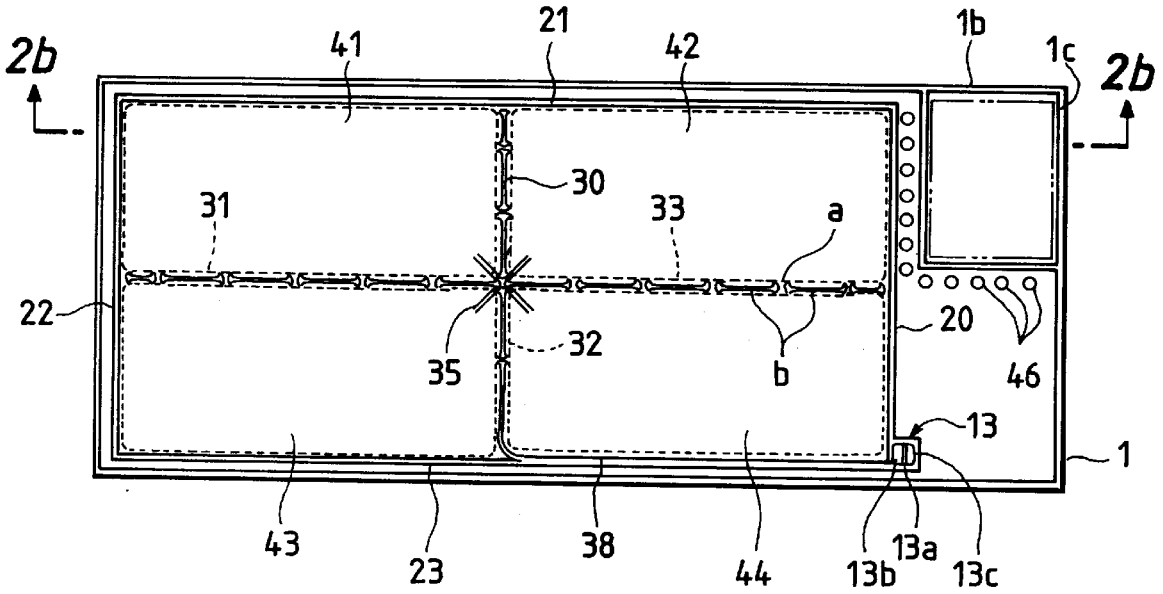
FIGS. 2(*a*) and 2(*b*) are diagrams showing a used ink tank according to the first aspect of the present invention, with FIG. 2(*a*) showing the bottom structure of the casing, and FIG. 2(*b*) showing the structure taken on line 2*b*—2*b* in FIG. 2(*a*)
Figure 2B:
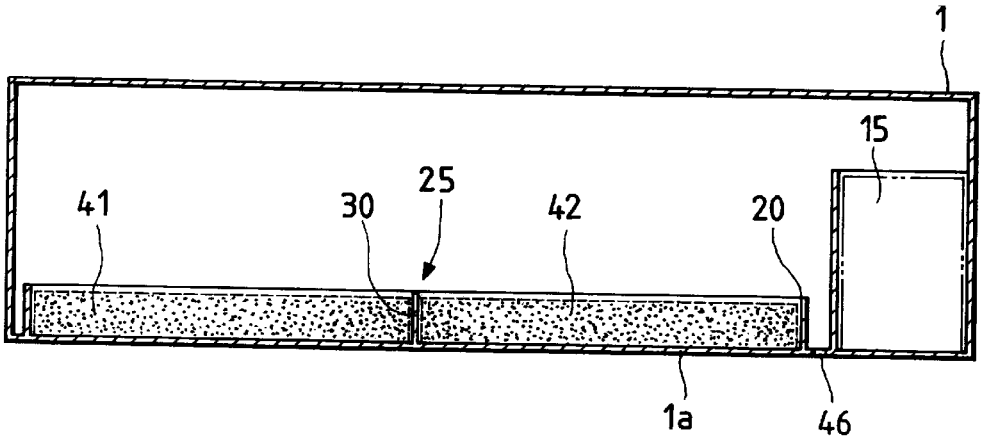
Figure 3:
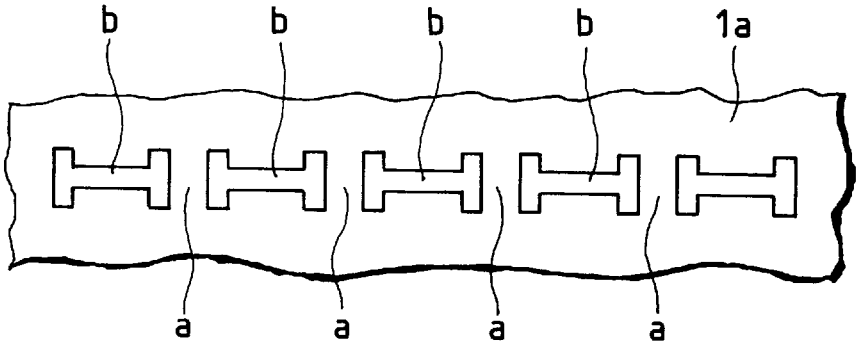
FIG. 3 is an enlarged view showing one of the partitioning plates of the casing.

FIGS. 2(*a*) and 2(*b*) show a used ink tank formed on the bottom portion of the casing. Side walls 20 to 23 define a used ink containing room 25. These side walls, formed integral with the bottom surface 1*a* of the casing 1, stand upright therefrom to be somewhat higher than the thickness of the ink absorbing substance to be described later. The inner space of the used ink containing room 25 is divided into a plural number of (four in this embodiment) segmental regions in accordance with a required ink holding capability, by partitioning plates 30 to 33. Each of the partitioning plates 30 to 33 is constructed such that pieces b, shaped like an H in cross section, are arranged so as to form through-holes a. The size of each of the through-holes a is selected so that these holes cannot hold ink by their capillary action, as shown in FIG. 3. A crisscross used ink distributor 35 for distributing used ink to the segmental regions is provided at the point where the partitioning plates 30 to 33 are joined to the bottom surface 1*a* of the casing.

Figure 4A:
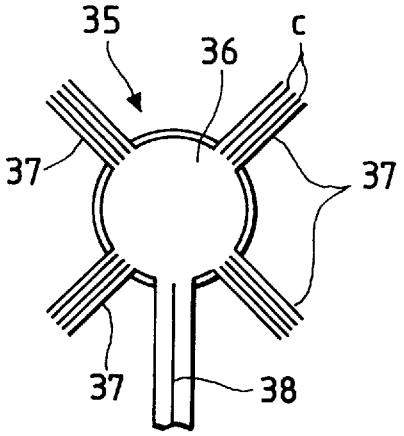
FIGS. 4(*a*) and 4(*b*) are plan and cross sectional views, respectively, showing a crisscross used ink distributor of the casing.
Figure 4B:
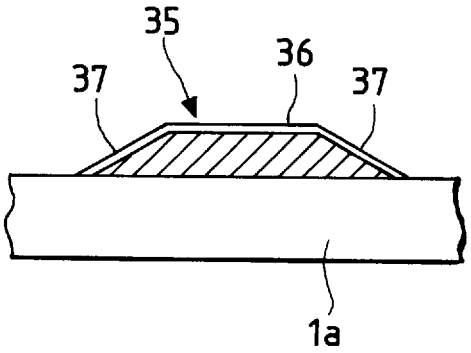

The crisscross used ink distributor 35 is illustrated in an enlarged form in FIGS. 4(*a*) and 4(*b*). As shown, the crisscross used ink distributor 35 includes a raised land 36 connected to a fluid path to be described later, and distributing paths 37 each consisting of linear grooves c. The grooves c are radially and outwardly extended from the raised land 36 while sloping down at a fixed angle.

Returning to FIG. 2(*a*), the used ink receiving port 13 is divided into two parts 13*b* and 13*c* by a partitioning plate 13*a*, and is connected to one end of a used ink path 38, which connects the port 13 to the crisscross used ink distributor 35.

Figure 5:
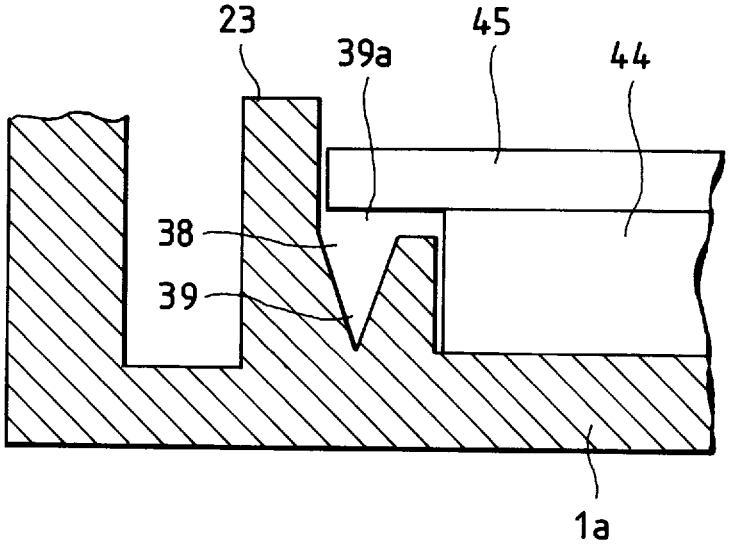
FIG. 5 is a cross sectional view showing the structure of a used ink fluid path for guiding used ink to the crisscross used ink distributor.

FIG. 5 shows a sectional view of the used ink fluid path 38 shown in FIGS. 2(*a*) and 4(*a*). The used ink fluid path 38 is formed by a groove 39 extended along the side wall 23 and the partitioning plate 32, which define the used ink containing room 25. The groove 39 is shaped like a V in cross section. The opening 39*a* of the groove 39 is wide enough to hold used ink therein by the capillary action, for example, 2 mm wide.

Numerals 41 to 44 designate plate-like segments of ink absorbing substance made of porous material, each segment having such a size as to fit into the corresponding segmental region.

A covering member 45 is provided for covering the used ink fluid path 38. The covering member is made of porous material of which the ink absorbing capability is comparable with that of the ink absorbing substance. Through-holes 46 are formed in the bottom surface la of the casing 1 while being arrayed half surrounding the power unit compartment 15 (see FIG. 2(*a*)).

In order to suck an ink equivalent liquid that is charged to the print head for test purposes, the tube 12 is inserted into the outside part 13*c* of the used ink receiving port 13, and a suction port of an external sucking means is positioned there, and a suction pump located exteriorly is operated.

Then, the suction pump 11 contained in the printer is operated. The ink equivalent liquid, sucked out of the print head 5, is led to the exterior suction pump before it flows into the used ink fluid path 38, and no ink equivalent liquid is left in the casing 1. After the discharging operation of the ink equivalent liquid ends, the tip of the tube 12 is pulled out of the part 13*c*, and inserted into the part 13*b*. Then, the product is delivered.

When the print head is first used or the clogging of the nozzle holes is removed, the openings of the nozzle holes are capped with the cap means 10, and the suction pump 11 is operated to forcibly suck ink from the power unit compartment 15.

By the forcible sucking operation, bubbles generated at the print head 5 and ink particles attached to the nozzle holes are discharged, together with ink, through the tube 12 to the used ink receiving port 13, in the form of used ink. The used ink flows through the used ink fluid path 38 having a V-shaped cross section and reaches the crisscross used ink distributor 35, and then is distributed into the respective segmental regions by way of the distributing paths 37. In the segmental regions, the used ink is absorbed by the plate-like segments of ink absorbing substance 41 to 44 located therein.

When the printer is placed in an inclined state and ink flows into one segmental region in a concentrated fashion, a large amount of used ink, in excess of that defined by the ink holding capability of the plate-like segments of ink absorbing substance, flows into the segmental region.

The used ink in excess of the volume of ink that can be absorbed by one ink absorbing segment flows to other adjacent segmental regions through the through-holes a of the partitioning plates 30 to 33, and is absorbed by the ink absorbing substance in those segmental regions. As a matter of course, the used ink will never flow out of the room since the used ink containing room 25 is closed by its side walls 20 to 23 and the used ink is confined within the room.

When the printer is improperly installed, for example, when the printer is placed in a state such that the used ink receiving port 13 is lower than the crisscross used ink distributor 35, the used ink moves to the crisscross used ink distributor 35 and flows into the segmental regions by the capillary force of the groove 39, so long as the height difference between them is within its tolerance, usually 3 cm, specified for the printer since the used ink fluid path 38 is formed by the V-shaped groove 39.

When the plate-like segments of ink absorbing substance 41 to 44 in the segmental regions having absorbed large amounts of used ink are greatly tilted to be vertical, for example, during their transportation, the used ink moves downward by gravity. In this case, no used ink will flow outside, however. The reason for this is that the ink absorbing segments are each separated to have the size smaller than that defined by its ink holding capability, and the water heads of the ink absorbing segments 41 to 44 are held down within their ink holding capabilities.

The plate-like segments of ink absorbing substance 41 to 44 are isolated from one another by the partitioning plates 30 to 33, so that no ink flow is caused among the segments of plate-like ink absorbing substance 41 to 44. Accordingly, the segments of plate-like ink absorbing substance 41 to 44 hold the amounts of used ink that are within their ink absorbing capabilities. As a result, the plate-like ink segments of absorbing substance 41 to 44 in the respective segmental regions can each accommodate an amount of the used ink that is approximately 80% of the volume of the ink absorbing substance.

In the thus constructed casing for the printer, the used ink will never flow out of the used ink containing room 25 irrespective of the attitude of the casing 1. If the used ink leaks from the used ink containing room, it will never reach the power unit compartment 15. The reason for this is as follows. The through-holes 46, which are formed so as to surround half of the power unit compartment 15, swiftly guide the ink to the outside of the casing 1, for drainage. If the ink is incompletely drained through the through-holes 46 and some amount of ink is left there, the partitioning walls 16 and 17 that are formed continuous with respect to the side walls and the bottom surface la of the casing 1, perfectly block the flow of the remaining ink to the power unit compartment 15.

Figure 6:
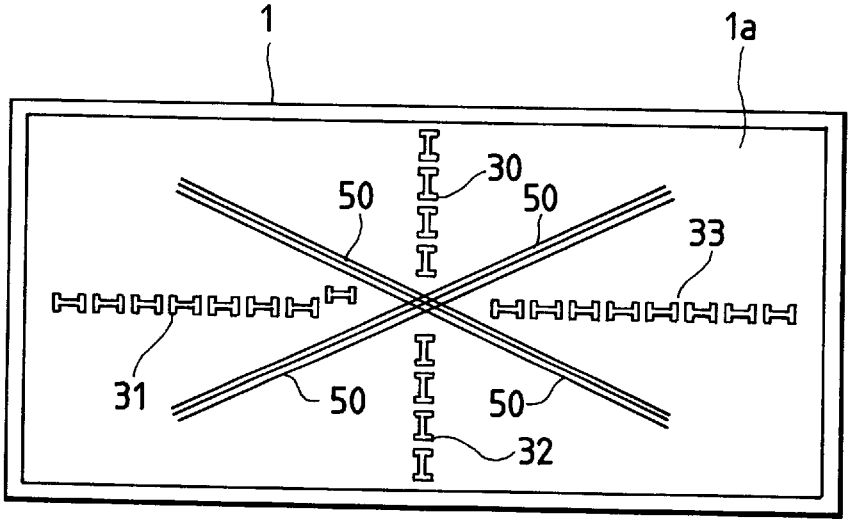
FIG. 6 is a plan view showing another embodiment of the present invention.

In the embodiment described above, the ink absorbing substance sequentially absorbs the used ink at the end. An alternative structure to absorb the ink is illustrated in FIG. 6. As shown, grooves 50 are formed in the bottom surface la of the casing 1. The grooves 50 are radially extended from the center of the bottom surface. The grooves 50 each have a width wide enough to hold used ink therein by capillary action, like the V-shaped grooves 39 described above. With such a structure, the contact area of ink with the ink absorbing substance is increased, so that the ink absorbing substance can absorb ink at the broader areas concurrently and uniformly.

In an additional structure to absorb the ink, grooves may be formed along the sides of the bottom surface of the casing, in addition to the radial grooves, used in the above ink absorbing structure. The additional ink absorbing structure enables the ink absorbing substance in the segmental regions to absorb the used ink more uniformly.

As seen from the foregoing description, a used ink containing room, defined by side walls, is formed on the bottom surface of a casing. The used ink containing room is divided into a plural number of segmental regions by partitioning plates. Segments of ink absorbing substance made of porous material are placed in the segmental regions, respectively. When the segments of ink absorbing substance are tilted and the effective lengths thereof are increased, degradation of the ink holding capability of each ink absorbing segment is small since the ink absorbing segments are isolated from one another. Accordingly, the ink absorbing segments, even if tilted, can absorb and hold an amount of ink approximate to the amount of ink defined by the ink absorbing capability of the ink absorbing substance. When the casing thus constructed is applied to an ink jet printer of the book type which must be slim in thickness, it can hold a large amount of used ink without increasing the size of the casing.

A compartment for containing a power unit is defined by two adjacent side walls of the casing and two partitioning walls continuous to the former. Further, through-holes are formed in the bottom surface of the casing at a location between the power unit compartment and the side walls partially defining the used ink containing room 25. If the ink leaks from the used ink containing room, it is swiftly discharged to the outside of the casing, through the through-holes. If the ink is incompletely drained through the through-holes and some amount of ink is left there, the partitioning walls perfectly block the flow of the remaining ink to the power unit compartment. Accordingly, the problems caused by the residual ink, such as shortcircuiting and electric leakage, do not arise in the structure of the casing of the invention. This leads to an improvement in the safety.

FIGS. 7–11(*c*) relate to an ink jet printer with a used in tank according to a second aspect of the present invention.

Since many of the elements shown in FIGS. 7–11(*c*) are the same as those shown in FIGS. 1–6, the same reference numbers have been used in connection with the second aspect of the present invention where appropriate, and the corresponding discussion has been dispensed with for the sake of brevity.

Figure 8A:
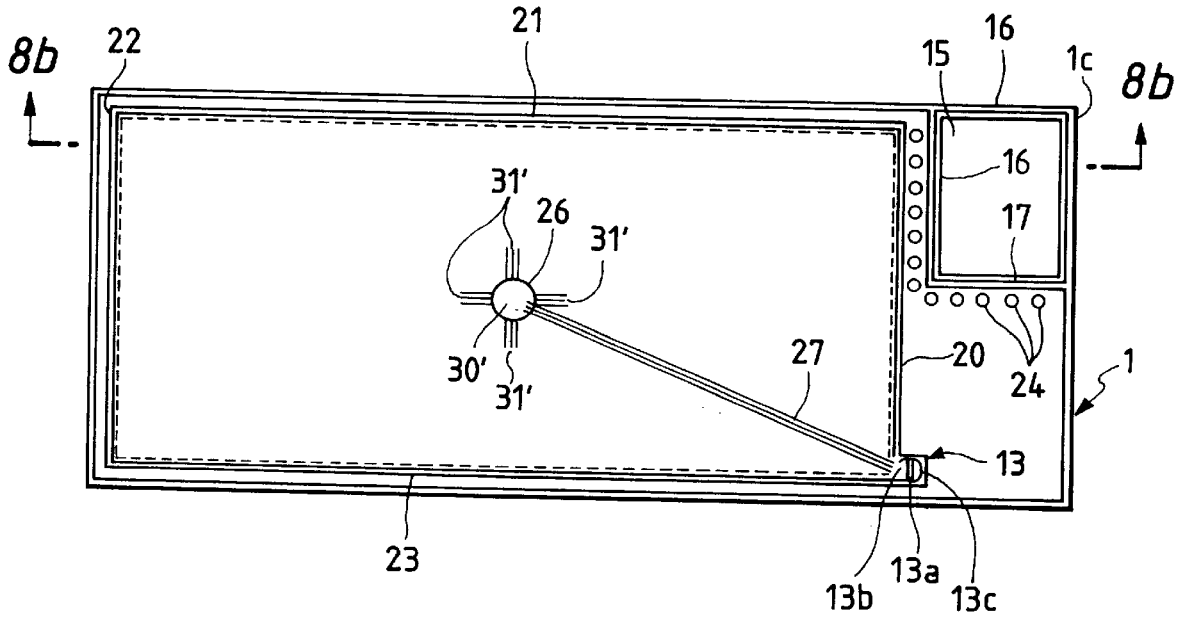
FIGS. 8(*a*) and 8(*b*) are diagrams showing a used ink tank according to the second aspect of the present invention, with FIG. 8(*a*) showing the bottom structure of the casing, and FIG. 8(*b*) showing the structure taken on line 8*b*—8*b* in FIG. 8(*a*)
Figure 8B:
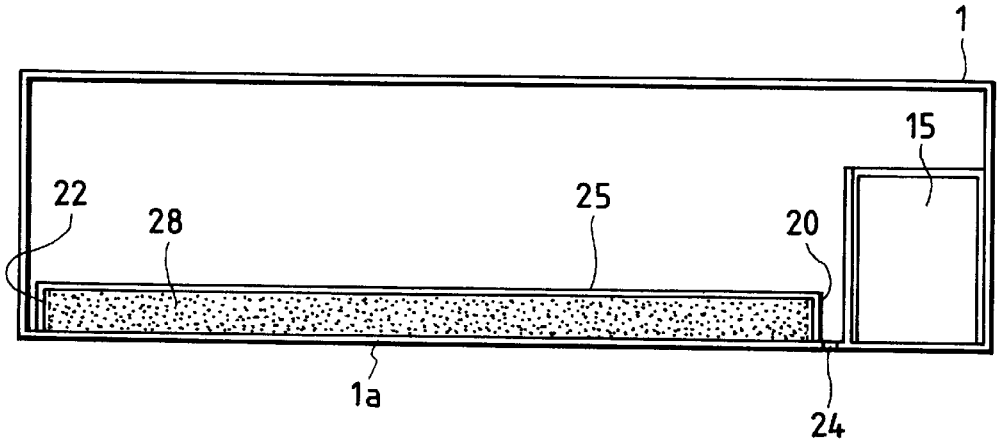
Figure 9A:
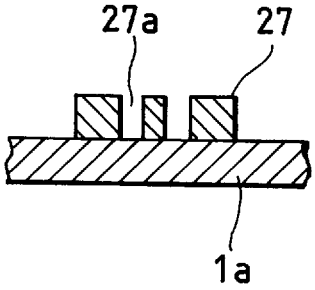
FIGS. 9(*a*) and 9(*b*) are cross sectional views showing an instance of a used ink guide path.
Figure 9B:
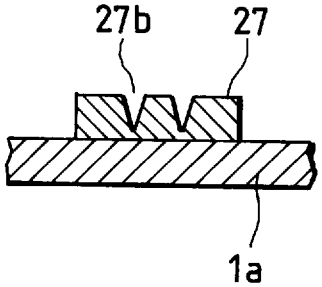

FIGS. 8(*a*) and 8(*b*) show a used ink tank formed on the bottom portion of the casing. Side walls 20 to 23 define a used ink containing room 25. These side walls, formed integral with the bottom surface 1*a* of the casing 1, stand upright therefrom to be somewhat higher than the thickness of an ink absorbing member 28 to be described later. A crisscross used ink distributor 26 (also described later) is provided at the central part of the used ink containing room 25. The crisscross used ink distributor 26 is connected to the used ink receiving port 13 through a used ink guide path 27. The used ink guide path 27 may be in the form of grooves 27*a* shaped like a U in cross section as shown in FIG. 9(*a*) or grooves 27*b* shaped like a V in cross section as shown in FIG. 9(*b*). The opening of the groove 27*a* or groove 27*b* is wide enough to hold used ink therein by capillary action, for example, 2 mm or less.

Figure 7:
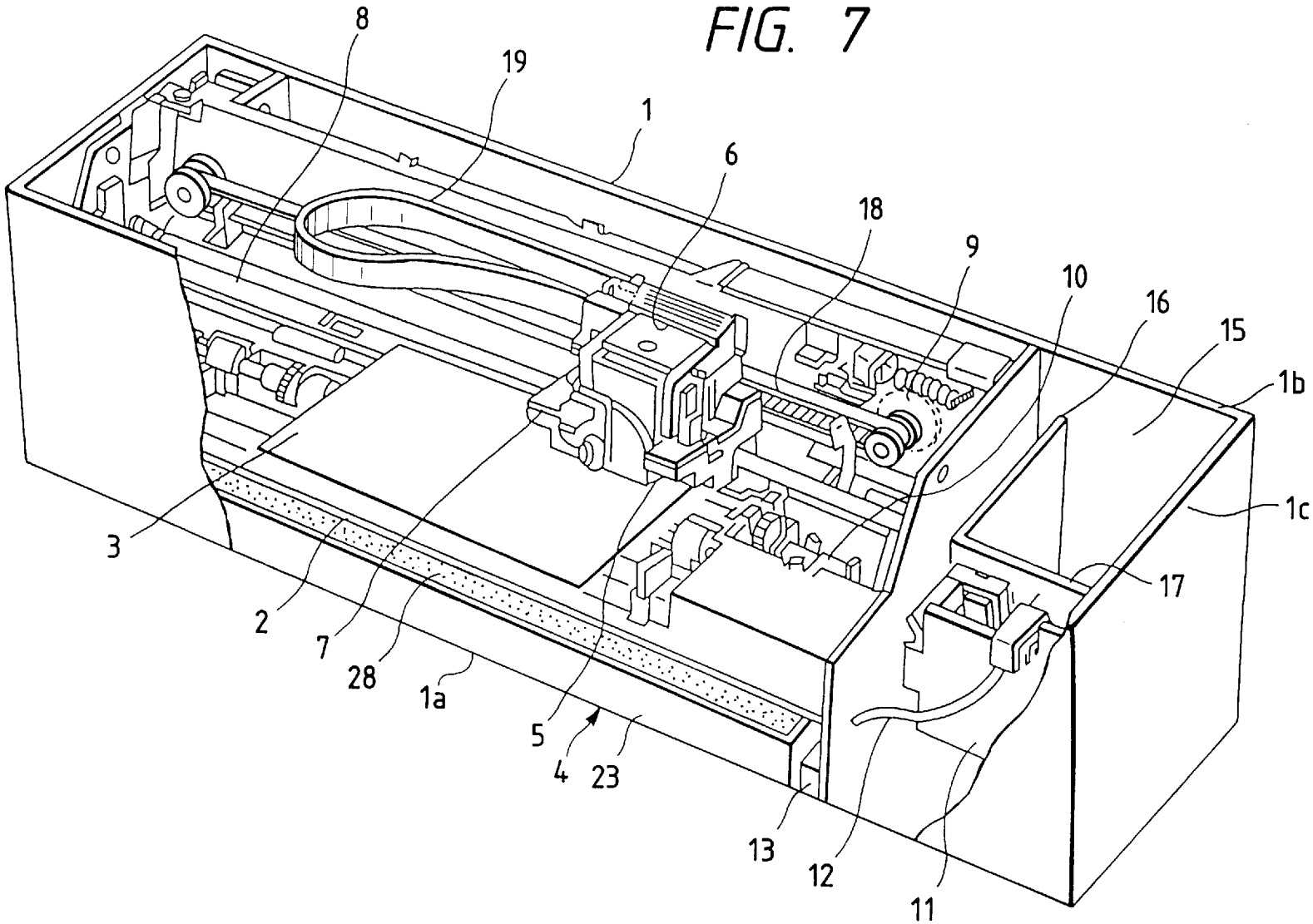
FIG. 7 is a perspective view showing an ink jet printer with a used ink tank constructed according to a second aspect of the present invention, a casing thereof being illustrated in a partial break-away fashion.

The ink absorbing member 28 (see FIGS. 7 and 8(*b*)) is formed in a manner such that shaping fibers are shaped into a plate-like member by a needle punch. The ink absorbing member 28 thus formed is placed in the used ink containing room 25, while covering the crisscross used ink distributor 26 and the used ink guide path 27.

Figure 10A:
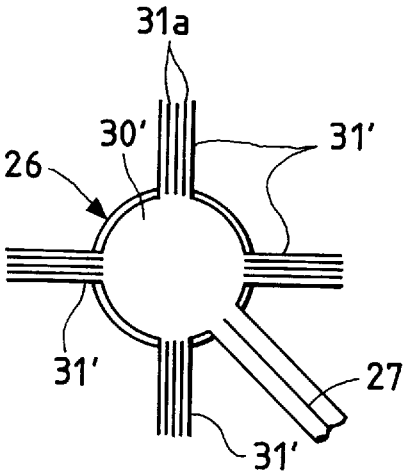
FIGS. 10(*a*) and 10(*b*) are plan and cross sectional views, respectively, showing a crisscross used ink distributor of the casing.
Figure 10B:
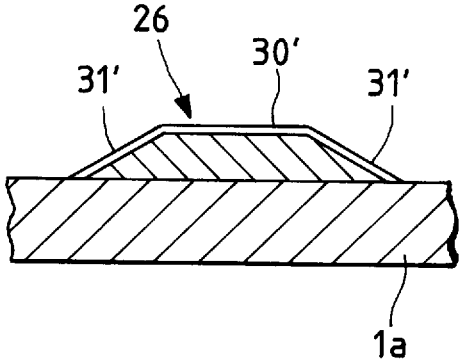

The crisscross used ink distributor 26 is illustrated in an enlarged form in FIGS. 10(*a*) and 10(*b*). As shown, the crisscross used ink distributor 26 includes a raised land 30' and distributing paths 31' each consisting of linear grooves 31*a*. The grooves 31*a* are radially and outwardly extended from the raised land 30' while sloping down at a fixed angle.

Returning to FIG. 8(*a*), the used ink receiving port 13 is divided into two parts 13*b* and 13*c* by a partitioning plate 13*a*. The part 13*b*, which is closer to the used ink containing room 25, is connected to the other end of the used ink guide path 27.

Figure 11A:
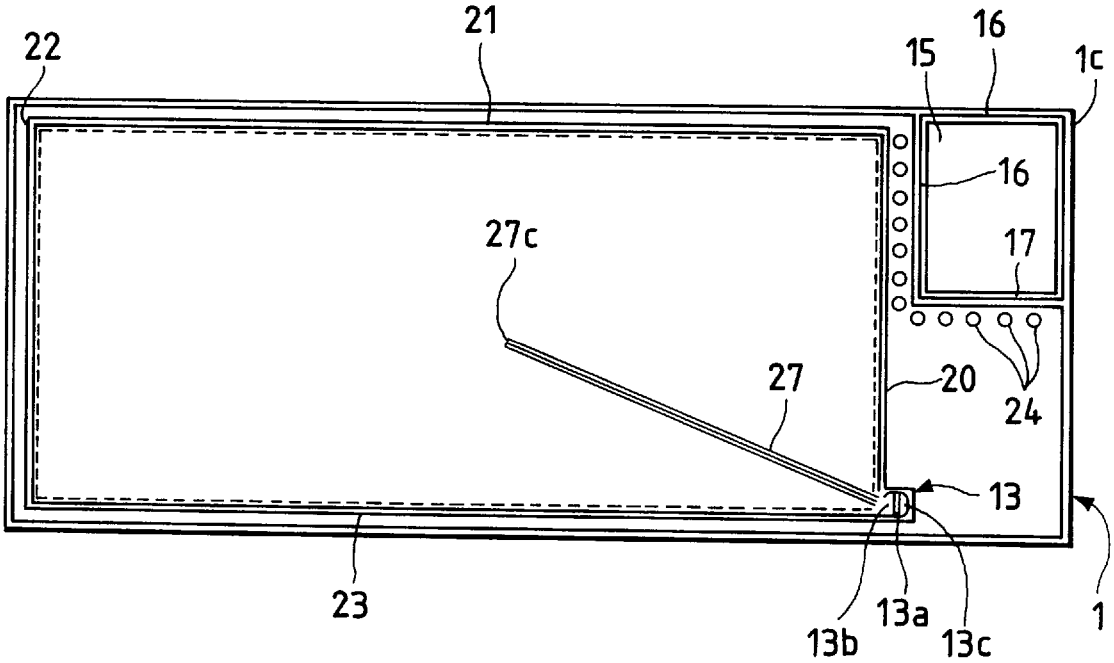
FIGS. 11(*a*), 11(*b*) and 11(*c*) show a still further embodiment of the present invention, with FIG. 11(*a*) being a plan view of the embodiment, and FIGS. 11(*b*) and 11(*c*) being plan and cross sectional views, respectively, showing in an enlarged form the end part of the used ink guide path.
Figure 11B:
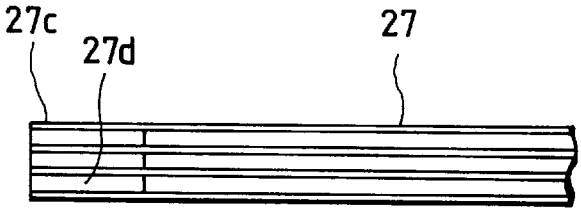
Figure 11C:
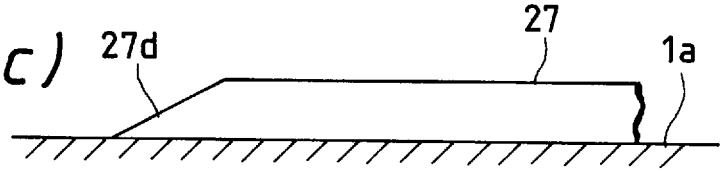

Through-holes 24 (see FIG. 11(*a*)) for used ink drainage are arrayed around the partitioning walls 16 and 17 defining the power unit compartment 15, viz., half surrounding the power unit compartment 15.

For test purposes, the tube 12 is inserted into the outside part 13*c* of the used ink receiving port 13, and a suction port of an external sucking means is positioned there, and a suction pump located exteriorly is operated.

Then, the suction pump 11 contained in the printer is operated. An ink equivalent liquid, which was charged into the print head 5 for test purposes, is sucked out of the print head 5 and led to the exterior suction pump before it flows into the used ink guide path 27, and no ink equivalent liquid is left in the casing 1. After the discharging operation of the ink equivalent liquid ends, the tip of the tube 12 is pulled out of the part 13*c*, and inserted into the part 13*b*. Then, the product is delivered.

When the print head is first used or the clogging of the nozzle holes is removed, the openings of the nozzle holes are capped with the cap member 10, and the suction pump 11 is operated to forcibly suck ink from the power unit compartment 15.

By the forcible sucking operation, bubbles generated at the print head 5 and ink particles attached to the nozzle holes are discharged, together with ink, through the tube 12 to the used ink receiving port 13, in the form of used ink. The used ink moves to reach the crisscross used ink distributor 26, by the capillary force of the used ink guide path 27. Then, it radially flows to the bottom surface la of the casing through the distributing paths 31', and is absorbed by the ink absorbing member 28 located there. Accordingly, even if the used ink was hardened at a region, it bypasses that region to flow to another region, and its absorption by the ink absorbing member 28 is ensured.

When the printer is improperly installed, for example, when the printer is placed in a state that the used ink receiving port 13 is lower than the crisscross used ink distributor 26, the used ink moves to the crisscross ink distributor 26 by the capillary force of the grooves 27*a* or 27*b* of the used ink guide path 27, and radially flows through the distributing paths 31' so long as the height difference between them is within its tolerance, usually 3 cm, specified for the printer. Consequently, the ink absorbing member 28 absorbs the used ink over a broader area.

If the used ink accidentally flows out of the used ink containing room 25, it is swiftly discharged outside the casing 1, through the through-holes 24 since half of the power unit compartment 15 is surrounded by the through-holes 24. If the ink is incompletely drained through the through-holes 24 and some amount of ink is left there, the partitioning walls 16 and 17 that are formed continuous with respect to the side walls 1*b* and 1*c* and the bottom surface la of the casing 1, perfectly block the flow of the remaining ink to the power unit compartment 15.

In the second aspect described above, the crisscross used ink distributor 26 is located at the end of the used ink guide path 27. An alternative structure is illustrated in FIGS. 11(*a*)–11(*c*). In the alternative, the end part 27*c* of the used ink guide path 27 is tapered as indicated by numeral 27*d* as shown in FIGS. 11(*b*) and 11(*c*). The tapered surface 27*d* terminates at the bottom surface 1*a* of the casing 1. With such a structure, the used ink flows from the tapered surface 27*d* to the bottom surface la, and is distributed into gaps which are formed by the bottom surface 1*a* and the ink absorbing member 28, by capillary force. Then, it is absorbed by a broad area of the ink absorbing member 28.

As seen from the foregoing description of the second aspect of the present invention, the structure of a casing in an ink jet printer has a print mechanism including an ink jet print head, a cap means for sealing the print head, and a pump, communicating with the cap means, for sucking ink from the print head. In the structure of a casing, a used ink containing room for receiving an ink absorbing member is formed on the bottom surface of the casing while being defined by side walls. Further, a power unit compartment for containing a power unit is defined by partitioning walls formed integral with the two adjacent side walls and the bottom surface of the casing, while facing one of the side walls defining the used ink containing room. With such a structure, the used ink can be completely absorbed by the used ink containing room. If the used ink leaks from the used ink containing room, the partitioning walls partially defining the power unit compartment perfectly block the flow of the used ink to the power unit compartment. Accordingly, the problems by the leaked ink, for example, shortcircuiting, are successfully solved, and the safety of the printer is improved.

Further, the used ink is led to the central part of the ink absorbing member, and is brought into contact with a broader area of the ink absorbing member. Even if the used ink is hardened at a region, it bypasses that region to flow to another region. In this respect, the casing of the invention is well adaptable particularly for an ink jet printer of the book type in which the thickness of the ink absorbing member is limited.

Although the present invention has been fully described by way of the preferred embodiments thereof with reference to the accompanying drawings, various changes and modifications will be apparent to those having skill in this field. Therefore, unless these changes and modifications otherwise depart from the scope of the present invention, they should be construed as included therein.

What is claimed is:

1. An ink jet printer casing for housing an ink jet printer, the ink jet printer having a print mechanism including an ink jet print head, a cap for sealing the print head, and a pump, communicating with the cap, for sucking ink from the print head, said ink jet printer casing comprising:

a bottom surface and a plurality of side walls extending upwardly from a periphery thereof and connected to each other;

a used ink containing room being formed on said bottom surface of said casing, said used ink containing room having a continuous outer periphery defined by upstanding walls extending upwardly from said bottom surface, said used ink containing room being divided into a plural number of segmental regions by partitioning plates; and separate segments of ink absorbing substance made of a porous material being placed in the segmental regions, respectively, wherein said segments of ink absorbing substance absorb the ink sucked from said print head by said pump.

2. The ink jet printer casing according to claim 1, wherein each of said segmental regions has a longest side with a length which is shorter than a height of an amount of ink that can be held by said ink absorbing substance when said ink absorbing substance is positioned upright.

3. The ink jet printer casing according to claim 1, wherein said partitioning plates contain through-holes, and the through-holes cannot hold ink by capillary action.

4. The ink jet printer casing according to claim 1, further comprising a used ink distributor provided at a point where said partitioning plates are joined together, and a used ink fluid path defined by a groove having a V-shaped cross section formed between a discharging port of said pump and said used ink distributor.

5. The ink jet printer casing according to claim 4, wherein said used ink distributor has a center for receiving used ink from said ink flow path, and said used ink distributor slopes down from the center to an outer part thereof.

6. The ink jet printer casing according to claim 1, further comprising grooves formed in the bottom surface of said casing and interconnecting said segmental regions.

7. The ink jet printer casing according to claim 1, further comprising a power unit compartment for containing a power unit and which is defined by partitioning walls formed integral with two adjacent side walls of said plurality of side walls and the bottom surface of said casing, while facing one of the upstanding walls defining said used ink containing room.

8. The ink jet printer casing according to claim 7, further comprising a plurality of through-holes for ink drainage formed in the bottom surface of said casing at least at a location between one of said upstanding walls of said used ink containing room and one of said partitioning walls of said power unit compartment.

9. An ink jet printer casing for housing an ink jet printer, the ink jet printer having a print mechanism including an ink jet print head, a cap for sealing the print head, and a pump, communicating with the cap, for sucking ink from the print head, said ink jet printer casing comprising:

a bottom surface and a plurality of side walls extending upwardly from a periphery thereof and connected to each other;

a used ink containing room formed on said bottom surface, said used ink containing room having a continuous outer periphery disposed within said periphery of said bottom surface, said continuous outer periphery being defined by upstanding walls extending upwardly from said bottom surface, said used ink containing room having an ink absorbing member disposed therein; and a power unit compartment for containing a power unit and which is defined by partitioning walls formed integral with two adjacent side walls of said plurality of side walls and the bottom surface, while facing one of the upstanding walls defining said used ink containing room.

10. The ink jet printer casing according to claim 9, further comprising a used ink receiving port for receiving ink from said pump, said used ink receiving port being in contact with one of said upstanding walls of said used ink containing room, and a used ink guide path, defined by narrow grooves, for connecting said used ink receiving port to a central part of said used ink containing room, wherein said ink absorbing member is disposed to cover said used ink guide path.

11. The ink jet printer casing according to claim 10, wherein an end part of said used ink guide path has a surface that is tapered at a predetermined angle and terminates at the bottom surface of said casing.

12. The ink jet printer casing according to claim 10, further comprising a used ink distributor for receiving used ink and which is connected to an end of said used ink guide path which is centrally located within said used ink containing room.

13. The ink jet printer casing according to claim 12, wherein said used ink distributor has a raised land for receiving used ink from said used ink guide path, and said used ink distributor slopes down from said raised land to an outer part thereof.

14. The ink jet printer casing according to claim 9, further comprising a plurality of through-holes for ink drainage formed in the bottom surface of said casing at least at a location between one of said upstanding walls of said used ink containing room and one of said partitioning walls of said power unit compartment.

15. The ink jet printer casing as recited in claim 1, further comprising a used ink receiving port which receives the ink sucked from said print head by said pump.

16. The ink jet printer casing as recited in claim 1, wherein said upstanding walls are displaced inwardly from said plurality of side walls.

* * * * *